US009049931B2

(12) United States Patent
Brinton, Jr. et al.

(10) Patent No.: US 9,049,931 B2
(45) Date of Patent: Jun. 9, 2015

(54) HANGER ASSEMBLIES FOR USE IN STORAGE SYSTEMS

(71) Applicant: Clairson, Inc., Newark, DE (US)

(72) Inventors: Daniel Wayne Brinton, Jr., Ocala, FL (US); Ernie Junior Torres, Gainesville, FL (US); Milind S. Nimgulkar, Pune (IN); Robert B. Anderson, III, Ocala, FL (US)

(73) Assignee: Clairson, Inc., Newark, DE (US)

( * ) Notice: Subject to any disclaimer, the term of this patent is extended or adjusted under 35 U.S.C. 154(b) by 0 days.

(21) Appl. No.: 14/042,902

(22) Filed: Oct. 1, 2013

(65) Prior Publication Data

US 2015/0053632 A1 Feb. 26, 2015

(30) Foreign Application Priority Data

Aug. 23, 2013 (IN) ..... 2756/MUM/2013

(51) Int. Cl.

*A47F 5/00* (2006.01)
*A47F 5/08* (2006.01)
*A47B 96/02* (2006.01)

(52) U.S. Cl.

CPC .. *A47B 96/02* (2013.01); *A47F 5/00* (2013.01)

(58) Field of Classification Search

CPC ..... A47B 96/02; A47B 96/06; A47F 5/01; F16B 7/0433; F16B 12/38; A47G 25/06
USPC ..... 211/134, 153, 123, 90.03, 105.1, 162; 248/249, 250, 304
See application file for complete search history.

(56) References Cited

U.S. PATENT DOCUMENTS

| | | | | | |
|---|---|---|---|---|---|
| 505,360 | A | | 9/1893 | Hilliard | |
| 1,347,808 | A | * | 7/1920 | Franklin | 403/119 |
| 2,120,748 | A | * | 6/1938 | Harris | 223/69 |
| 3,765,634 | A | * | 10/1973 | Stempel | 248/250 |
| 3,921,814 | A | * | 11/1975 | Solomon | 211/162 |
| 4,316,593 | A | * | 2/1982 | Miner et al. | 248/250 |
| 4,374,498 | A | * | 2/1983 | Yellin | 108/181 |
| 4,777,888 | A | * | 10/1988 | Waterman et al. | 108/108 |
| D349,000 | S | | 7/1994 | Rogers et al. | |
| 5,350,072 | A | | 9/1994 | Rogers et al. | |
| 5,351,842 | A | * | 10/1994 | Remmers | 211/90.03 |
| D352,195 | S | | 11/1994 | Rogers et al. | |
| 5,405,026 | A | | 4/1995 | Lee et al. | |
| 5,492,295 | A | * | 2/1996 | Remmers | 248/251 |
| 5,520,118 | A | * | 5/1996 | McCarthy | 108/42 |
| 5,531,416 | A | | 7/1996 | Remmers | |

(Continued)

*Primary Examiner* — Daniel J Troy
*Assistant Examiner* — Kimberley S Wright
(74) *Attorney, Agent, or Firm* — Harness, Dickey & Pierce, P.L.C.

(57) ABSTRACT

A shelving unit includes a wire shelf having multiple wire members arranged to form a platform, at least one bracket configured to releasably couple to wire members of the wire shelf, and a rod coupled to the bracket. The bracket includes a hook-shaped end portion and an elbow portion. The hook-shaped end portion of the bracket defines a channel that opens toward the elbow portion for receiving a first one of the wire members, and the elbow portion of the bracket defines a bend for receiving a second one of the wire members to thereby releasably couple (e.g., snap fit, etc.) the bracket to the wire shelf. The shelving unit may also include a stop for inhibiting movement of hangers along the rod and past the stop, and/or a connector for coupling the shelving unit to a rod of another shelving unit for allowing movement of hangers between the rods.

18 Claims, 14 Drawing Sheets

(56) References Cited

U.S. PATENT DOCUMENTS

| | | | | |
|---|---|---|---|---|
| 5,695,080 | A * | 12/1997 | Martin | 211/183 |
| 5,725,110 | A * | 3/1998 | Kluge et al. | 211/87.01 |
| 5,758,851 | A * | 6/1998 | Remmers | 248/251 |
| D427,466 | S | 7/2000 | Remmers | |
| D437,515 | S | 2/2001 | Remmers et al. | |
| 6,340,141 | B1 * | 1/2002 | Rinderer | 248/49 |
| 6,913,235 | B2 * | 7/2005 | Oberhaus | 248/250 |
| 7,004,335 | B2 | 2/2006 | Remmers | |
| 7,086,544 | B1 * | 8/2006 | Doench | 211/105.1 |
| D527,559 | S | 9/2006 | Remmers | |
| D527,935 | S | 9/2006 | Remmers | |
| 7,185,772 | B2 | 3/2007 | Remmers | |
| 7,392,911 | B2 * | 7/2008 | Stitchick et al. | 211/90.02 |
| D580,258 | S * | 11/2008 | Fernandez | D8/381 |
| 7,516,930 | B2 * | 4/2009 | Chen | 248/304 |
| D621,244 | S * | 8/2010 | Kundinger et al. | D8/381 |
| 7,900,783 | B2 * | 3/2011 | Fernandez et al. | 211/90.02 |
| 7,946,549 | B2 * | 5/2011 | Forrest et al. | 248/249 |
| 8,177,172 | B2 * | 5/2012 | Quertelet et al. | 248/68.1 |
| 8,646,624 | B2 * | 2/2014 | Fernandez et al. | 211/90.02 |
| 8,910,805 | B2 * | 12/2014 | Gregory et al. | 211/113 |
| 2004/0045920 | A1 | 3/2004 | Remmers | |
| 2005/0077261 | A1 | 4/2005 | Remmers | |
| 2006/0261230 | A1 * | 11/2006 | Lee | 248/304 |
| 2007/0108146 | A1 * | 5/2007 | Nawrocki | 211/119.003 |
| 2009/0139943 | A1 * | 6/2009 | Fernandez | 211/94.01 |
| 2015/0060383 | A1 * | 3/2015 | Gregory et al. | 211/186 |

* cited by examiner

HANGER ASSEMBLIES FOR USE IN STORAGE SYSTEMS

CROSS-REFERENCE TO RELATED APPLICATION

This application claims the benefit and priority of India Patent Application No. 2756/MUM/2013 filed Aug. 23, 2013. The entire disclosure of the above application is incorporated herein by reference.

FIELD

The present disclosure generally relates to storage systems and, more particularly, to hanger assemblies for use in such storage systems.

BACKGROUND

This section provides background information related to the present disclosure which is not necessarily prior art.

Efficient and organized use of building space is very desirable, particularly with respect to storage or utility space in both businesses and residential settings. Because of limited or tight spaces in these locations, maximizing the amount of useable space is very important. Likewise, providing ease in accessing stored items, such as clothing, is important. Further, ease in moving stored items to make room for other items or to access items not readily accessible, is likewise important.

SUMMARY

This section provides a general summary of the disclosure, and is not a comprehensive disclosure of its full scope or all of its features.

Example embodiments of the present disclosure generally relate to storage systems. In one example embodiment, a shelving unit suitable for use in a storage system generally includes a wire shelf having multiple wire members arranged to form a platform, a bracket configured to releasably couple to wire members of the wire shelf, and a rod coupled to the bracket. The bracket includes a hook-shaped end portion and an elbow portion. The hook-shaped end portion of the bracket defines a channel that opens toward the elbow portion for receiving a first one of the wire members, and the elbow portion of the bracket defines a bend for receiving a second one of the wire members to thereby releasably couple the bracket to the wire shelf. In various aspects of the present disclosure, the coupling between the bracket and the wire members of the wire shelf is a snap-fit coupling that allows, for example, the brackets to be coupled to the wire members, uncoupled from the wire members, and recoupled to the wire members as desired.

In another example embodiment, a shelving unit generally includes a wire shelf having multiple wire members arranged to form a platform, a bracket configured to releasably couple to the wire shelf, and a rod coupled to the bracket. The bracket includes an end portion configured to receive a first one of the wire members of the wire shelf and an elbow portion configured to receive a second one of the wire members of the wire shelf. The bracket also includes a lip portion disposed adjacent the elbow portion, where a distance between the end portion of the bracket and the lip portion is less than a distance between the end portion of the bracket and the elbow portion such that the lip portion operates to at least partially retain the second one of the wire members in the elbow portion when the bracket is releasably coupled to the wire shelf.

Example embodiments of the present disclosure also generally relate to hanger assemblies for use with wire shelves (e.g., as part of storage systems, shelving units, etc.). In one example embodiment, a hanger assembly generally includes at least one bracket configured to releasably couple to a wire shelf, and a rod coupled to the at least one bracket. The at least one bracket includes a border (e.g., extending from end portion to end portion of the bracket, etc.) defining a common interior region for receiving wire members of the wire shelf therein when releasably coupling the at least one bracket to the wire shelf.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIG. 4 is a side elevation view of a bracket of the hanger assembly of

Figure 1:
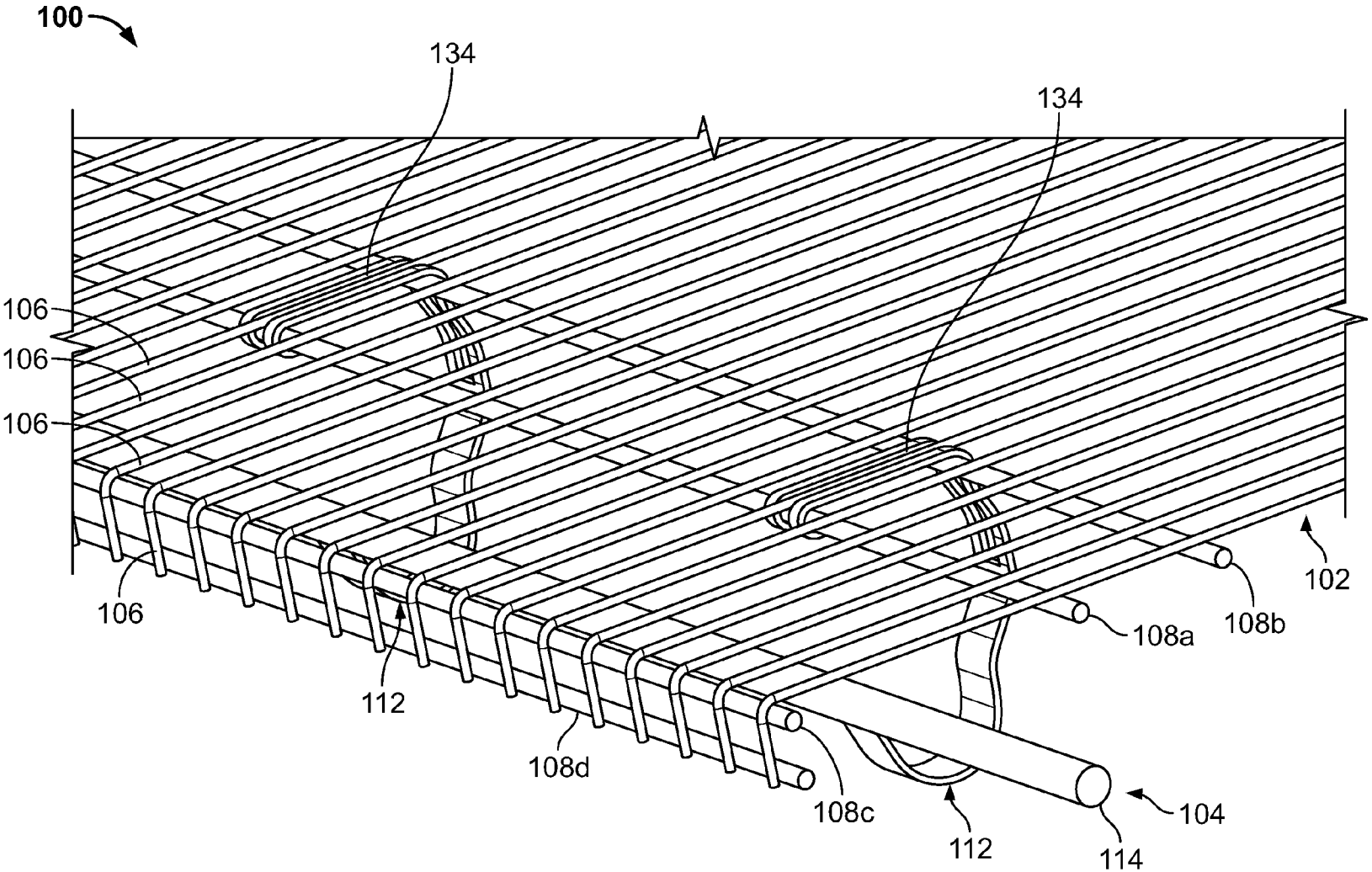
FIG. 1 is a perspective view of a shelving unit according to an example embodiment of the present disclosure.
Figure 5:
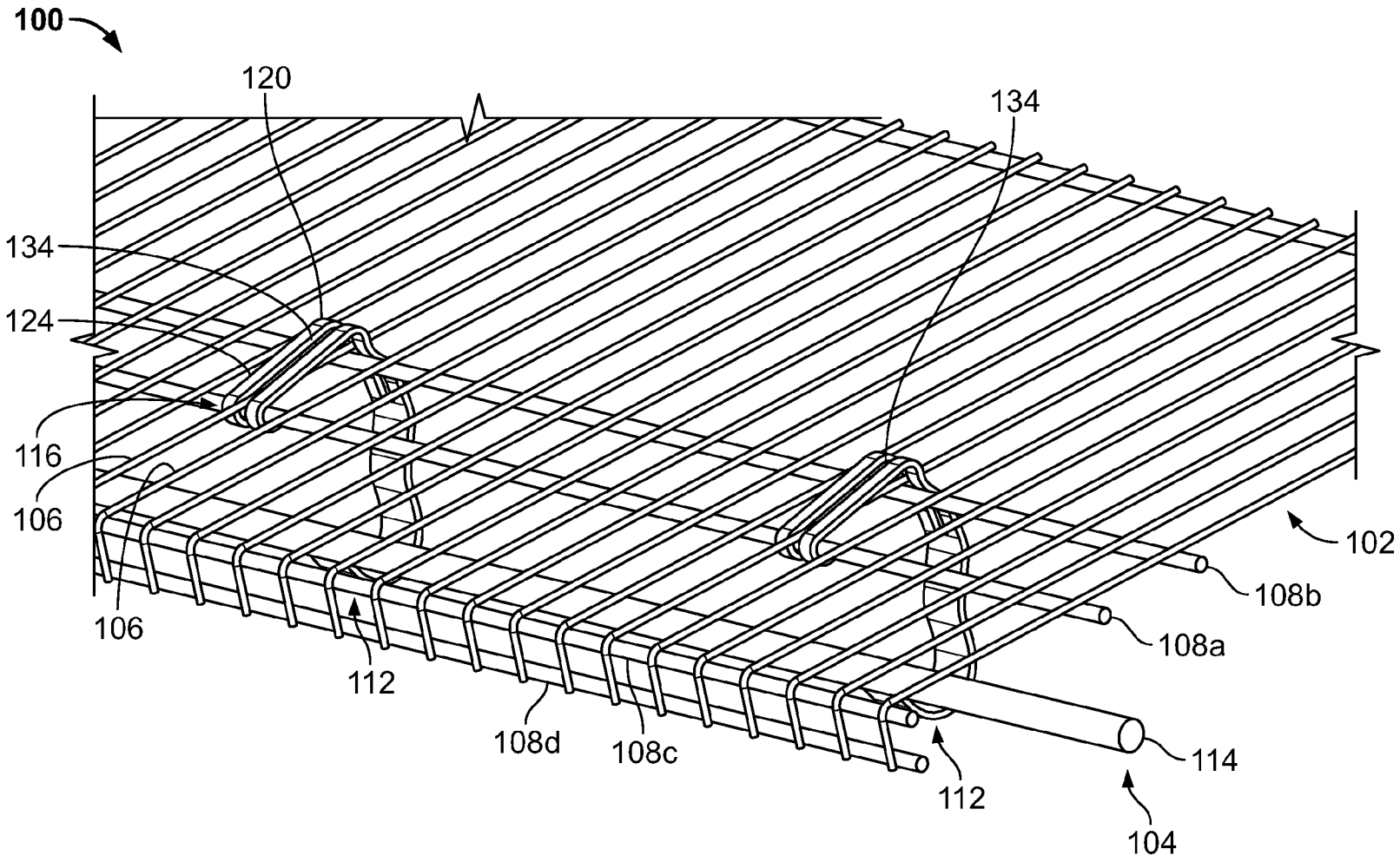
Figure 6:
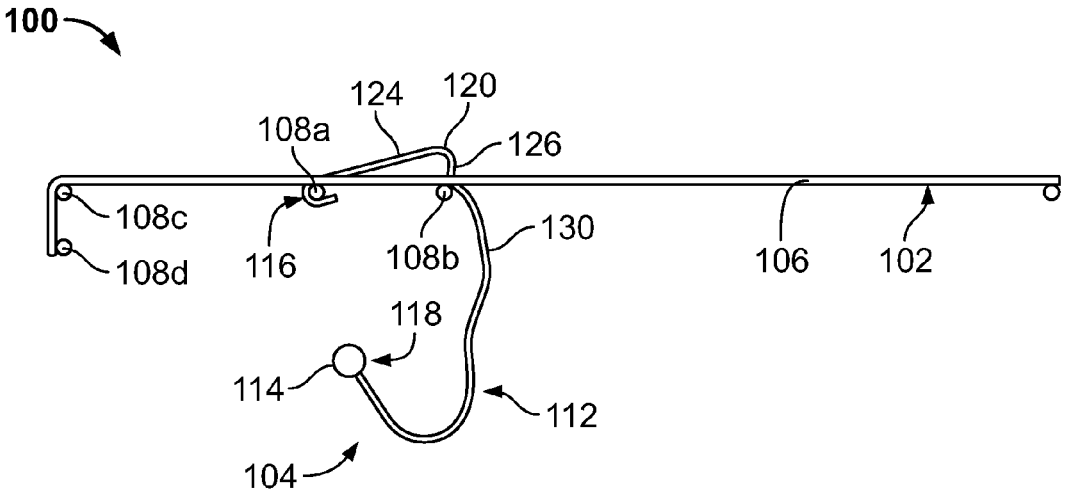
Figure 7:
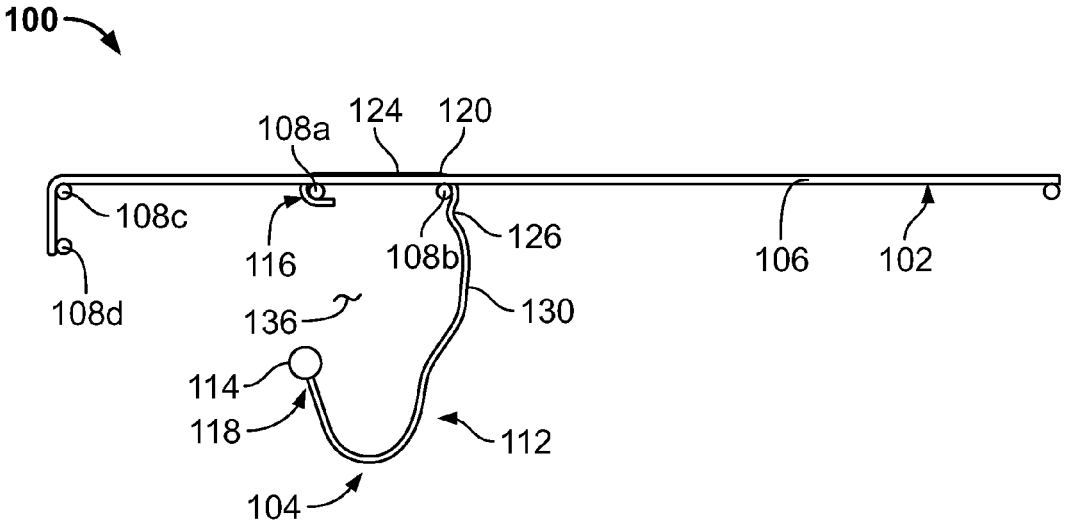
Figure 8:
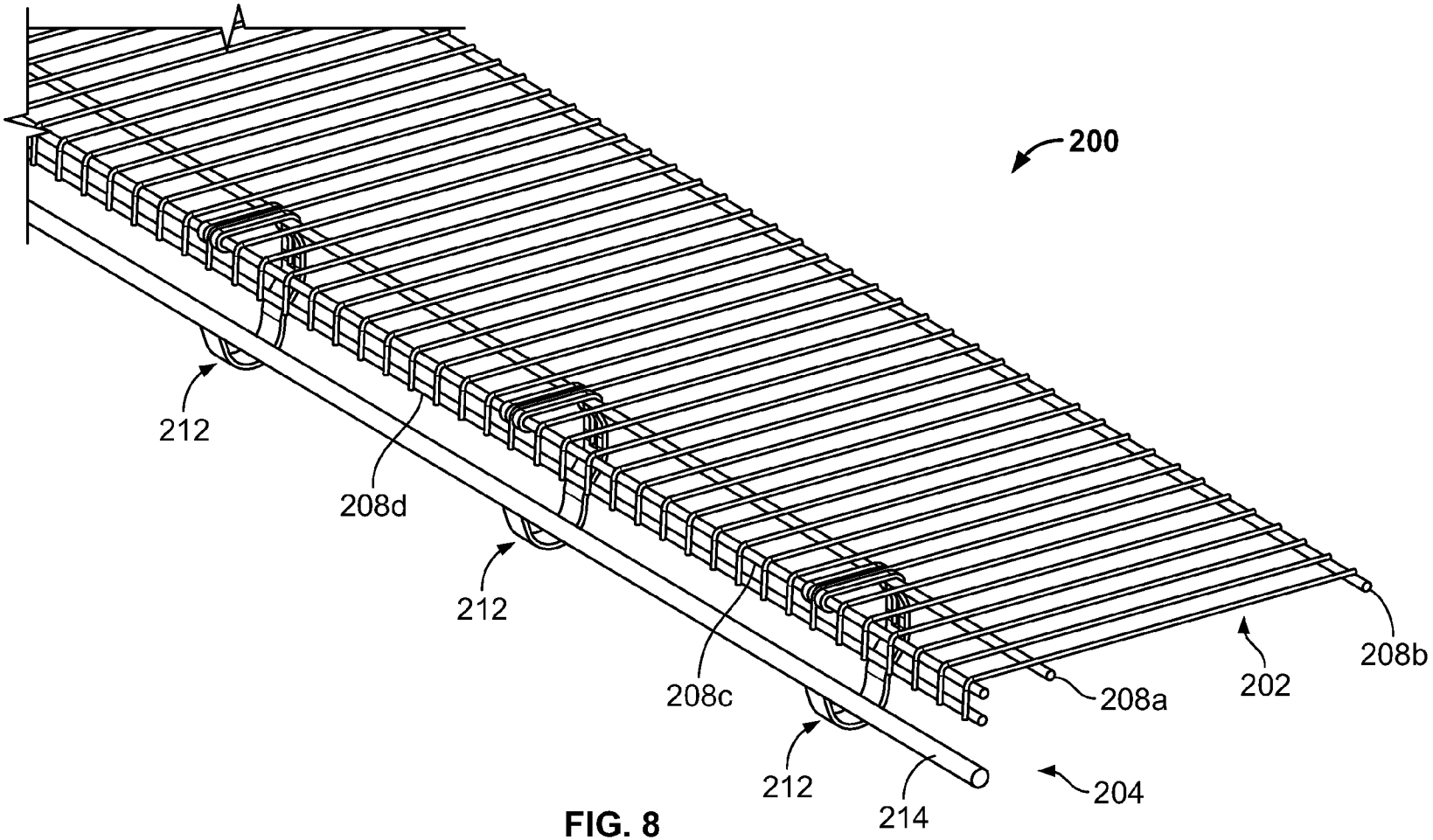
Figure 9:
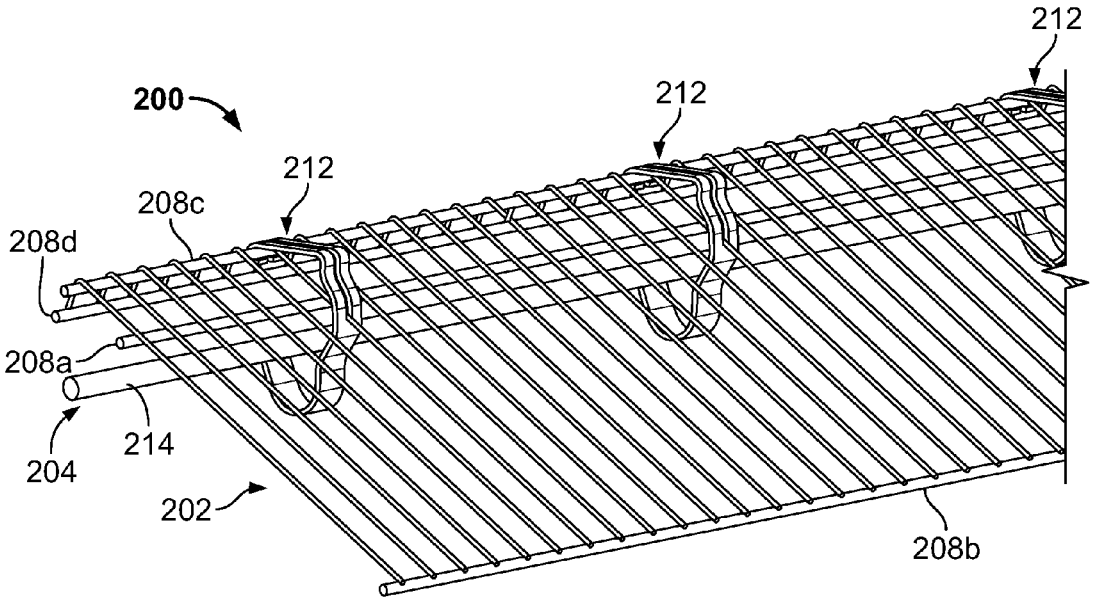
Figure 10:
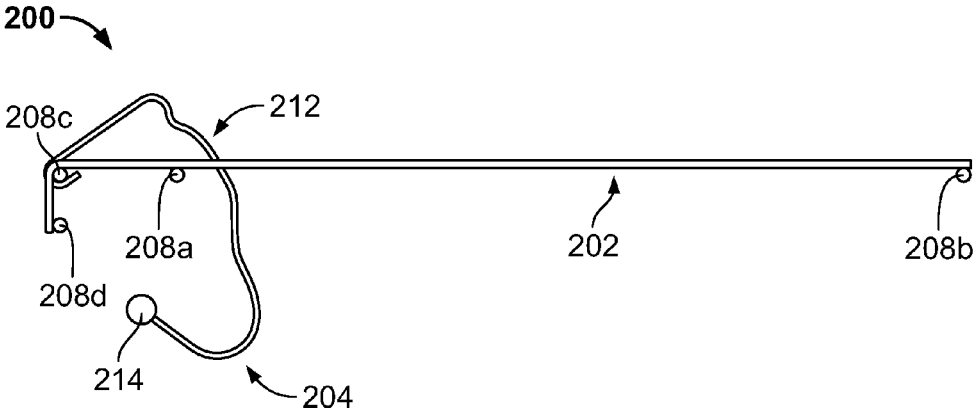
Figure 11:
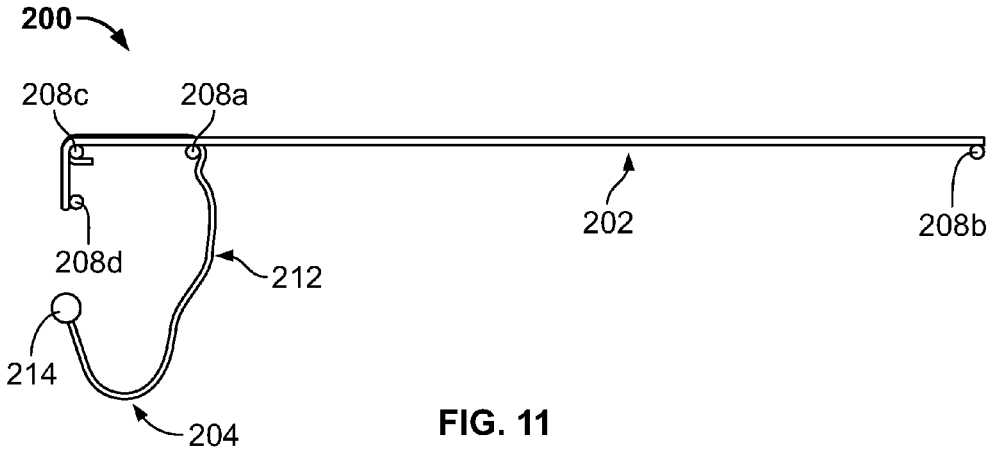
Figure 12:
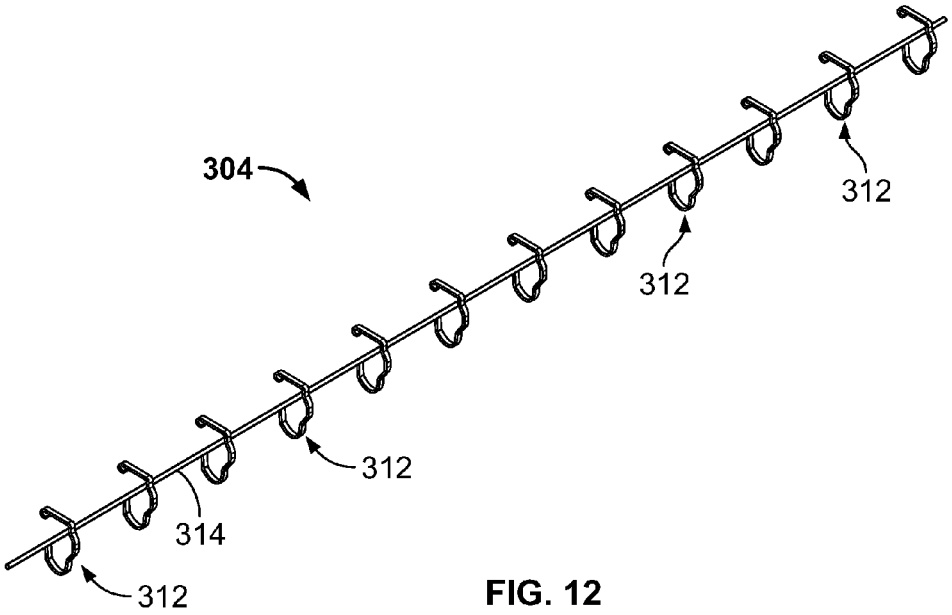
Figure 13:
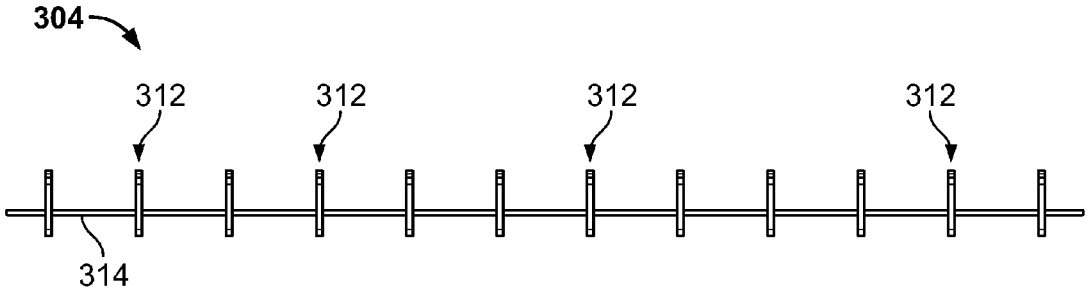
Figure 14:
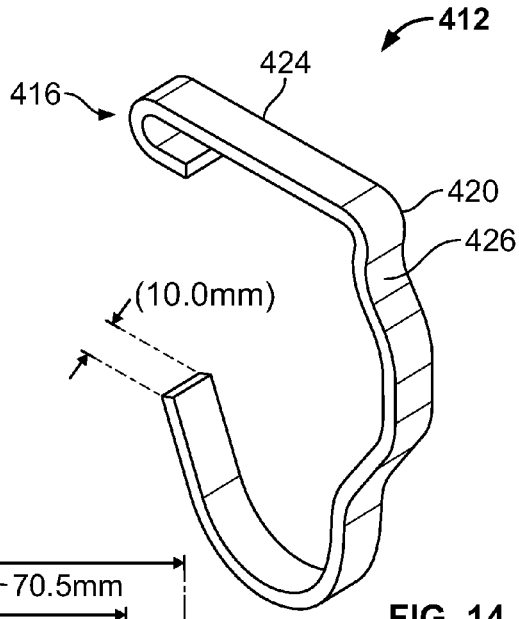
Figure 15:
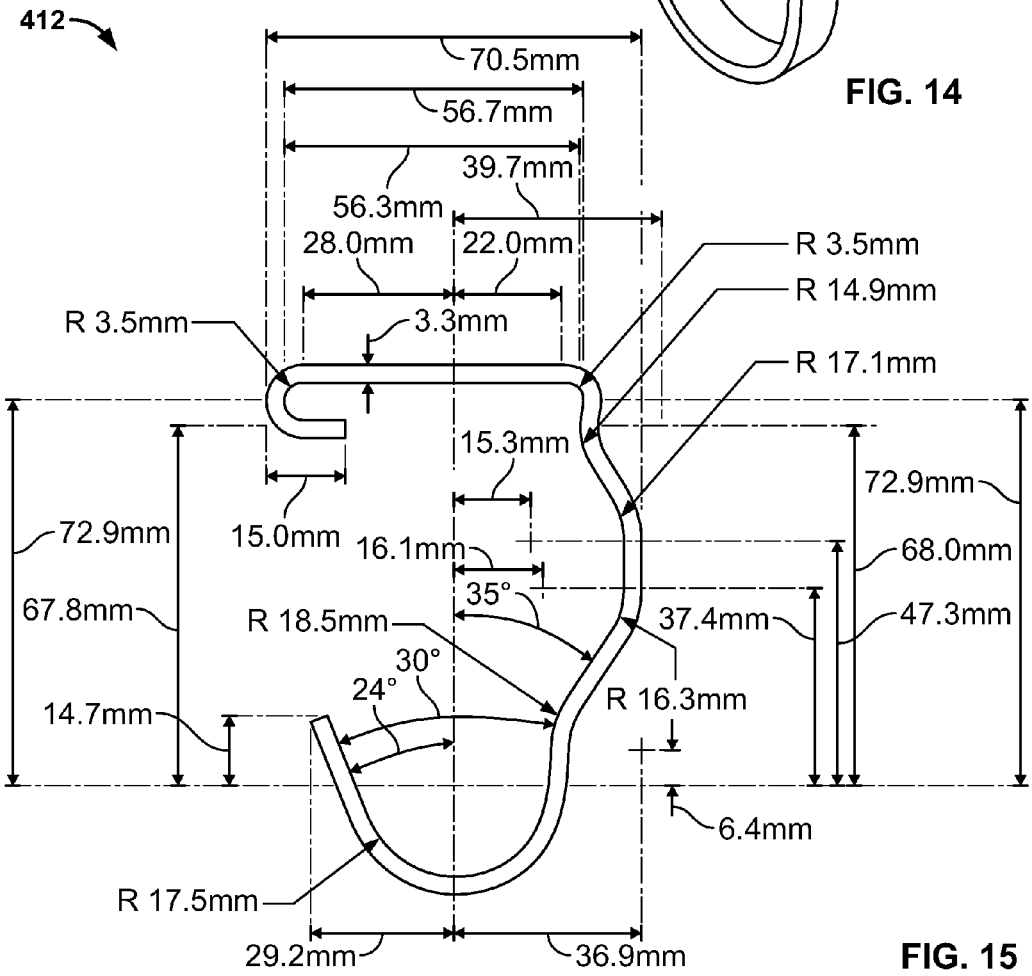
Figure 16:
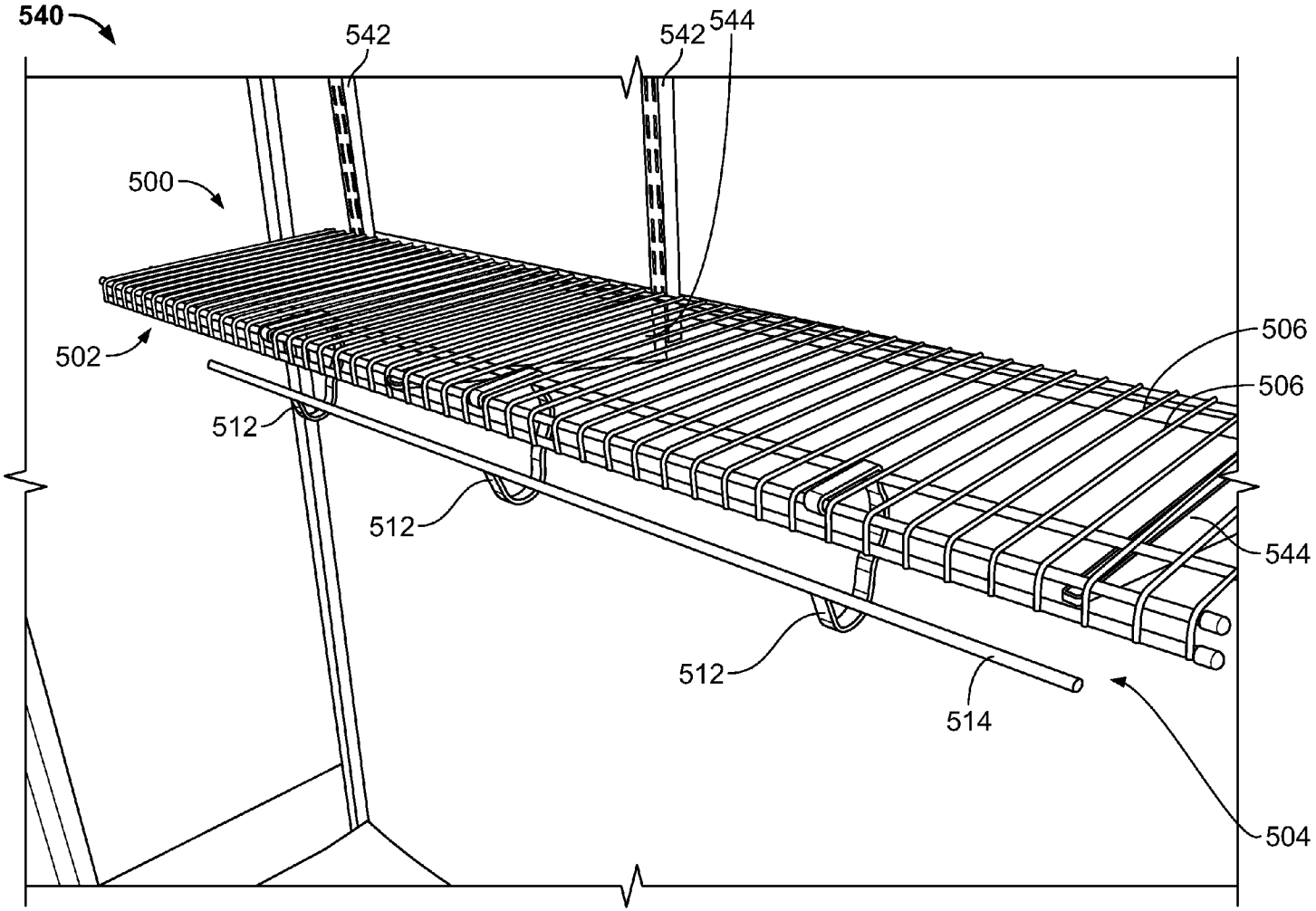
Figure 17:
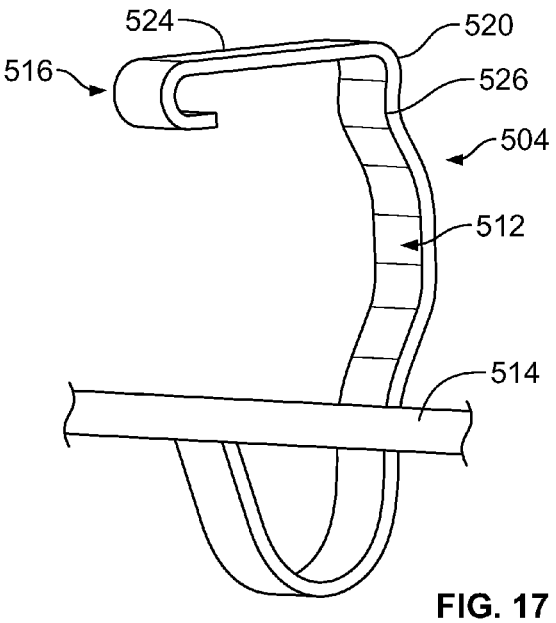
Figure 18A:
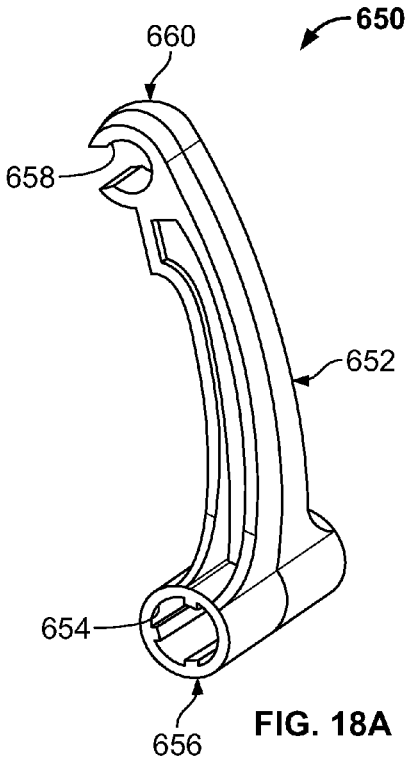
Figure 18B:
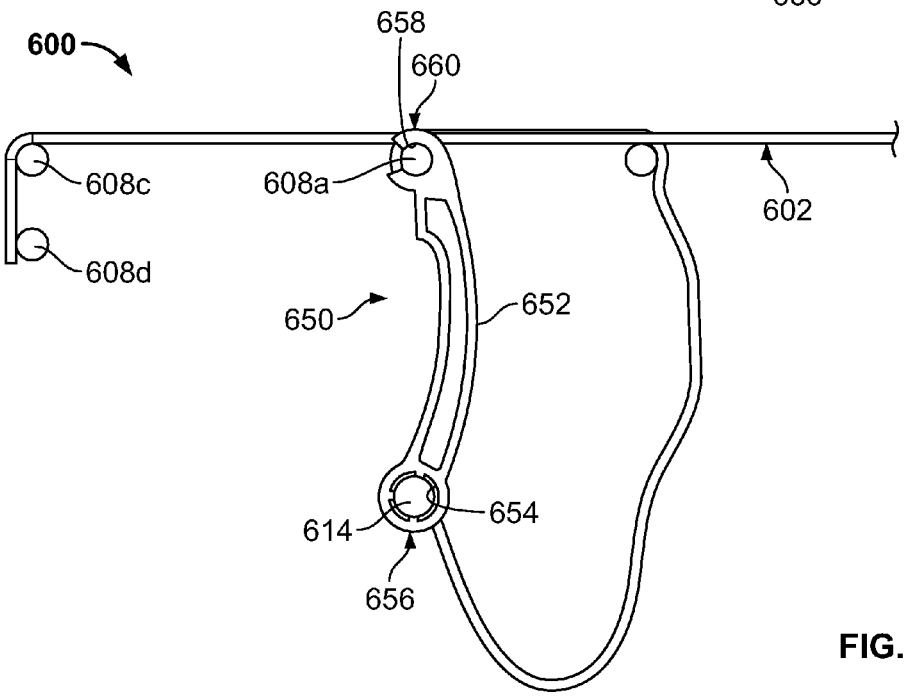
Figure 19:
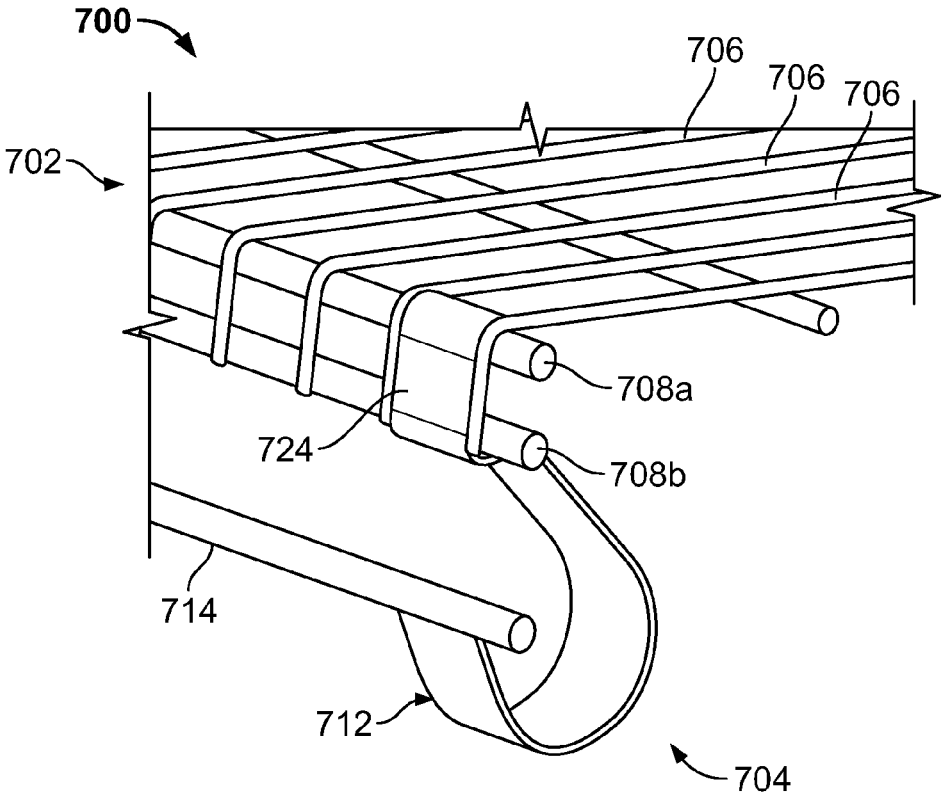
Figure 20:
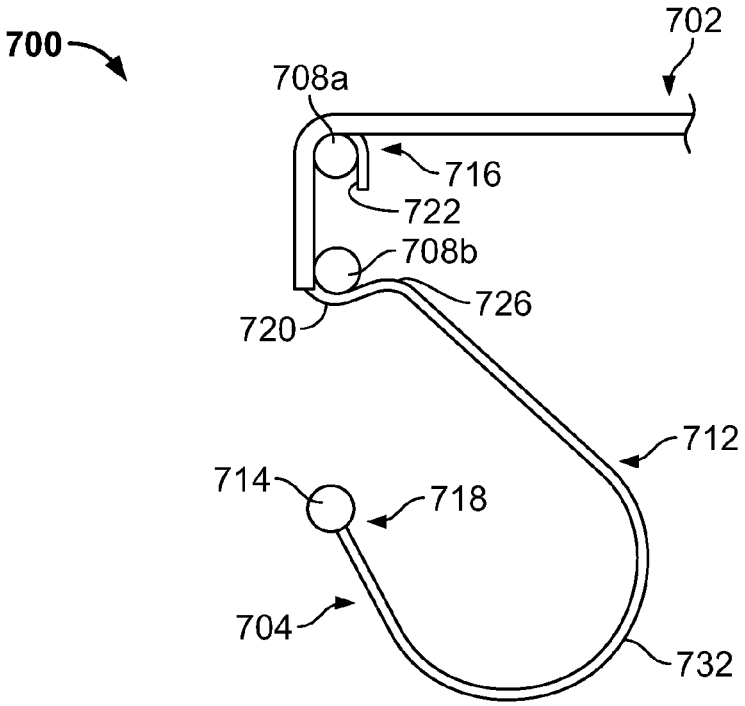
Figure 21:
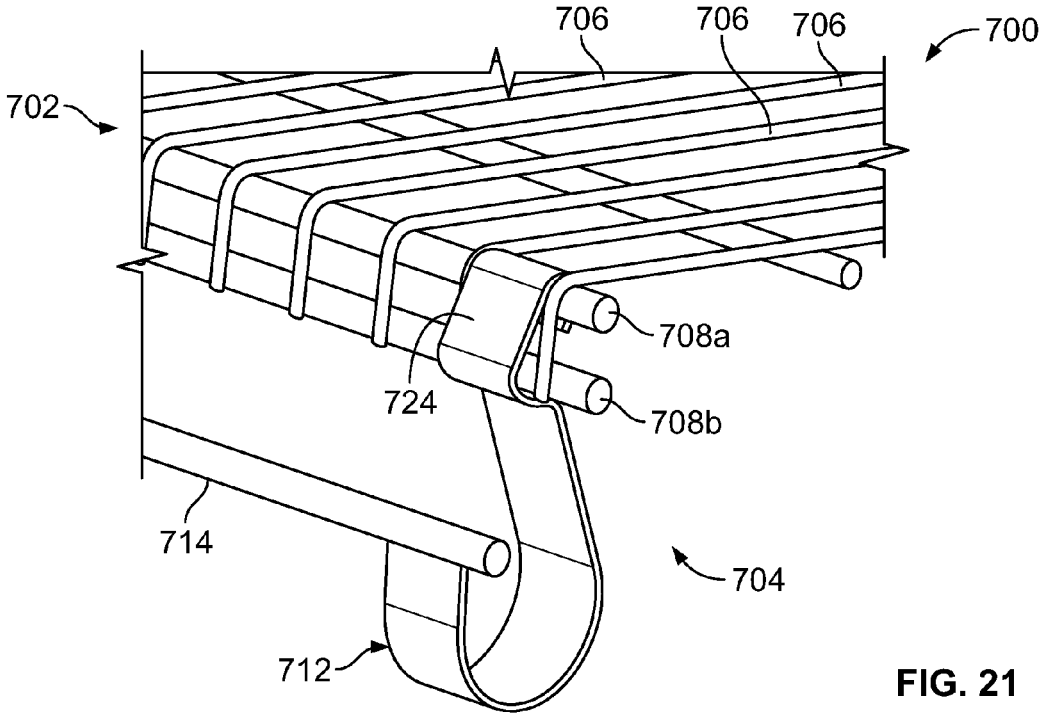
Figure 22:
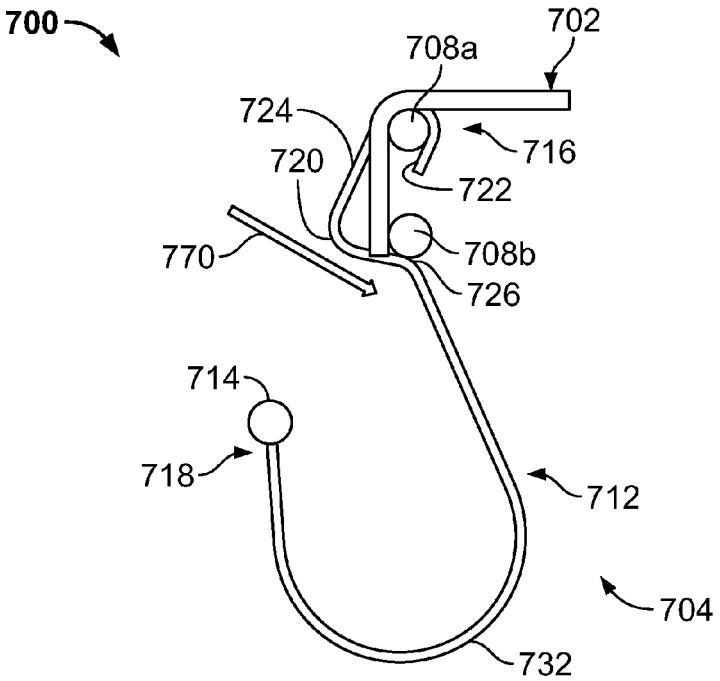
Figure 24:
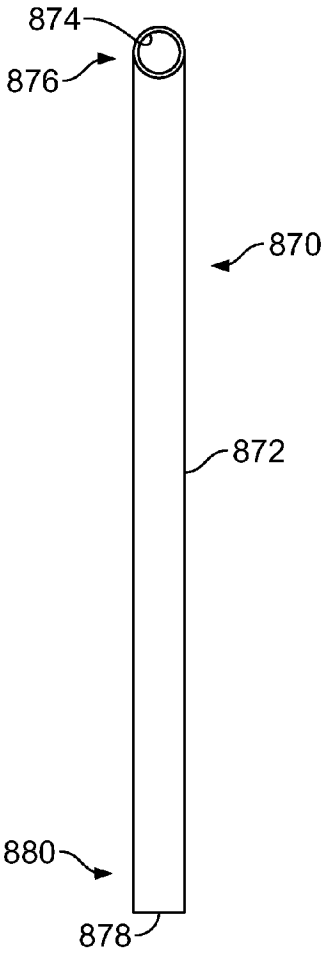
Figure 23:
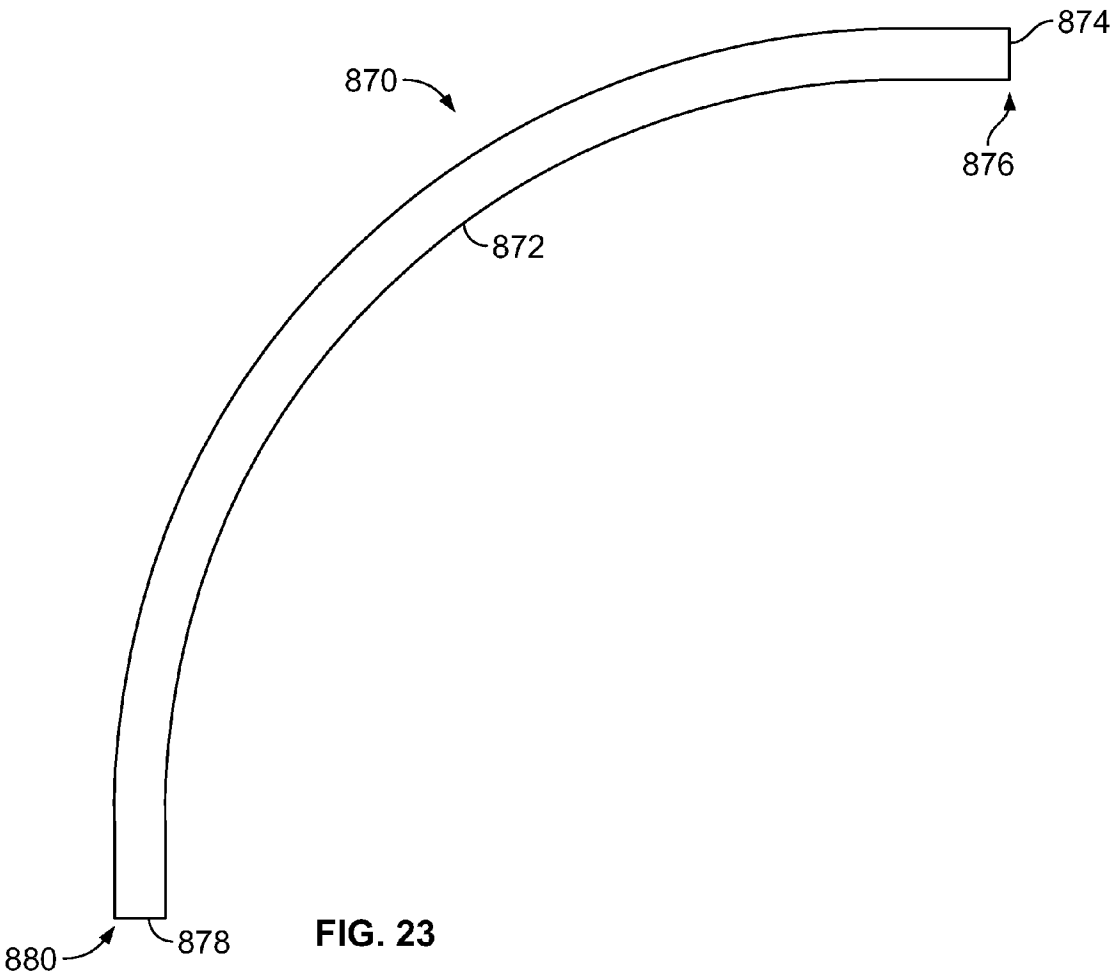
Figure 25:
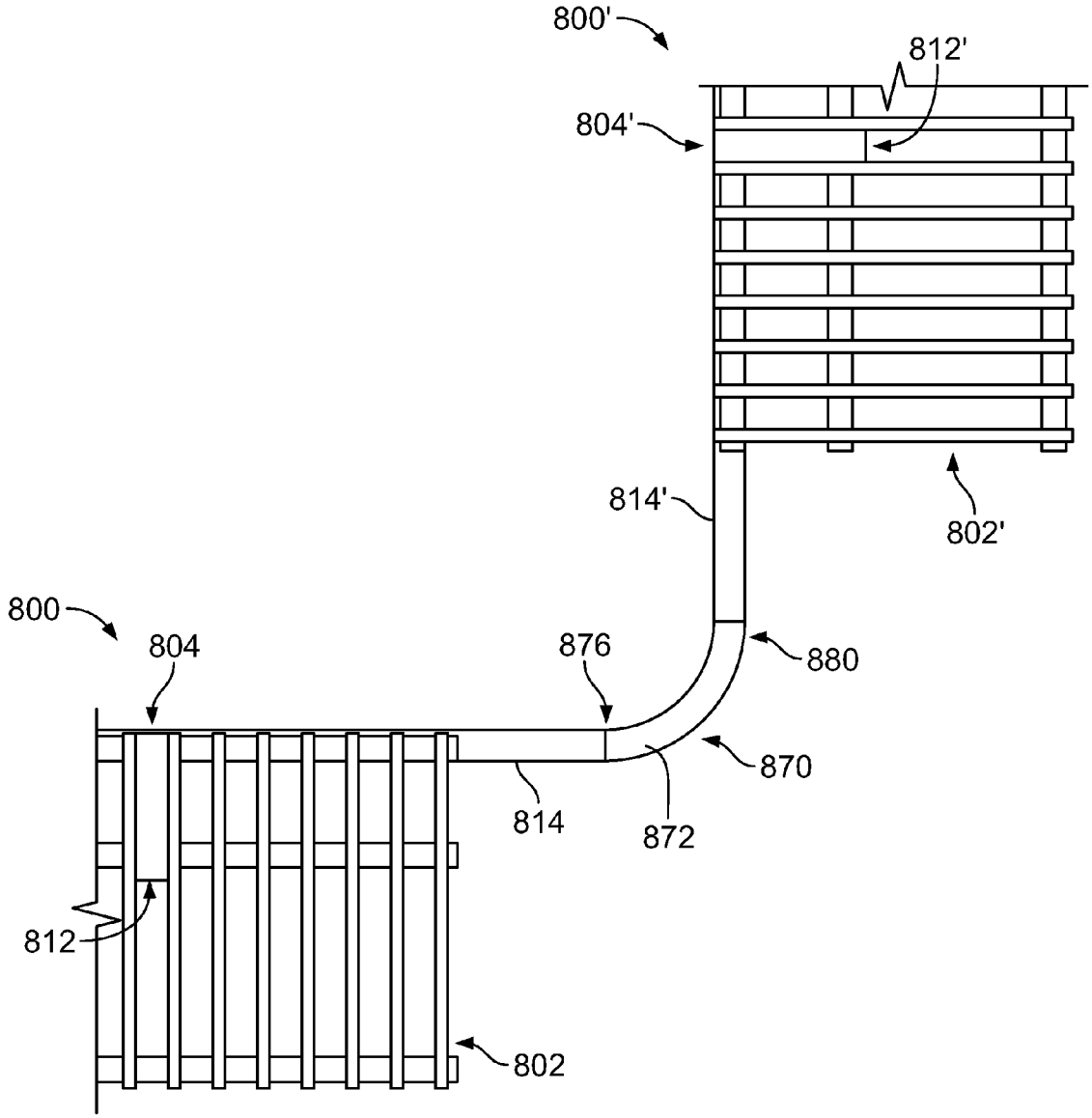

FIG. 2;

FIG. 5 is another perspective view of the shelving unit of FIG. 1, illustrating installation of the hanger assembly to a wire shelf of the shelving unit;

FIG. 6 is a side elevation view of the shelving unit of FIG. 5, illustrating the installation of the hanger assembly to the wire shelf of the shelving unit;

FIG. 7 is a side elevation view of the shelving unit of FIG. 1, illustrating the hanger assembly installed to the wire shelf of the shelving unit;

FIG. 8 is a perspective view of a shelving unit according to another example embodiment of the present disclosure;

FIG. 9 is another perspective view of the shelving unit of FIG. 8, illustrating installation of a hanger assembly to a wire shelf of the shelving unit;

FIG. 10 is a side elevation view of the shelving unit of FIG. 9, illustrating installation of the hanger assembly to the wire shelf of the shelving unit;

FIG. 11 is a side elevation view of the shelving unit of FIG. 8, illustrating the hanger assembly installed to the wire shelf of the shelving unit;

FIG. 12 is a perspective view of a hanger assembly according to another example embodiment of the present disclosure;

FIG. 13 is a front elevation view of the hanger assembly of FIG. 12;

FIG. 14 is a perspective view of a bracket according to another example embodiment of the present disclosure with dimensions provided for purpose of illustration only;

FIG. 15 is a side elevation view of the bracket of FIG. 14 with dimensions provided for purpose of illustration only;

FIG. 16 is a fragmentary perspective view of a storage system according to an example embodiment of the present disclosure;

FIG. 17 is a fragmentary perspective view of a hanger assembly of the storage system of FIG. 16;

FIG. 18A is a perspective view of a stop according to an example embodiment of the present disclosure and configured for use with shelving units of the present disclosure;

FIG. 18B is a side elevation view of the stop of FIG. 18A installed in a shelving unit of the present disclosure;

FIG. 19 is a perspective view of a shelving unit according to another example embodiment of the present disclosure;

FIG. 20 is a side elevation view of the shelving unit of FIG. 19;

FIG. 21 is another perspective view of the shelving unit of FIG. 19, illustrating installation of a hanger assembly of the shelving unit to a wire shelf of the shelving unit;

FIG. 22 is a side elevation view of the shelving unit of FIG. 21, illustrating the installation of the hanger assembly to the wire shelf of the shelving unit;

FIG. 23 is an upper plan view of a corner connector according to an example embodiment of the present disclosure and configured for use with shelving units of the present disclosure;

FIG. 24 is a side elevation view of the corner connector of FIG. 23; and FIG. 25 is an upper plan view of the corner connector of FIG. 23 shown installed to shelving units of the present disclosure.

DETAILED DESCRIPTION

Example embodiments will now be described more fully with reference to the accompanying drawings.

FIGS. 1-7 illustrate an example embodiment of a shelving unit 100 including one or more aspects of the present disclosure. The shelving unit 100 can be used to store desired items and may, for example, form part of a closet storage system within the scope of the present disclosure (see, e.g., closet storage system 540 in FIG. 17, etc.).

As shown in FIG. 1, the shelving unit 100 generally includes a wire shelf 102 and a hanger assembly 104 configured to couple thereto. The wire shelf 102 provides a surface for holding, stacking, etc. items on the shelving unit 100. And, the hanger assembly 104 allows for hanging desired items using, for example, clothes hangers, etc. from the shelving unit 100. The wire shelf 102 can have any desired size (e.g., a twelve inch depth, a sixteen inch depth, etc.), and the hanger assembly 104 can be coupled to the wire shelf 102 at any desired location (e.g., at a twelve inch hang, etc.).

The wire shelf 102 generally includes multiple wire members arranged to form a platform (e.g., for stacking, storing, etc. items). The wire members include multiple wire stringers 106, and multiple support members 108*a-d* arranged generally transverse to the wire stringers 106 for providing support to the wire stringers 106. The wire stringers 106 are spaced to provide a ventilated structure for the wire shelf 102 while preventing relatively large items stored on the wire shelf 102 from passing between spaces between the wire members. Other configurations and/or arrangements of the wire members of the wire shelf 102 are possible as aspects of the present disclosure are not limited to any particular number, shape, size, and/or arrangement of wire members. In one example, non-limiting aspect, wire stringers of a wire shelf may be formed from 4.5 gauge wire and spaced apart about two inches. However, other sizes and/or spacing may be used.

Figure 2:
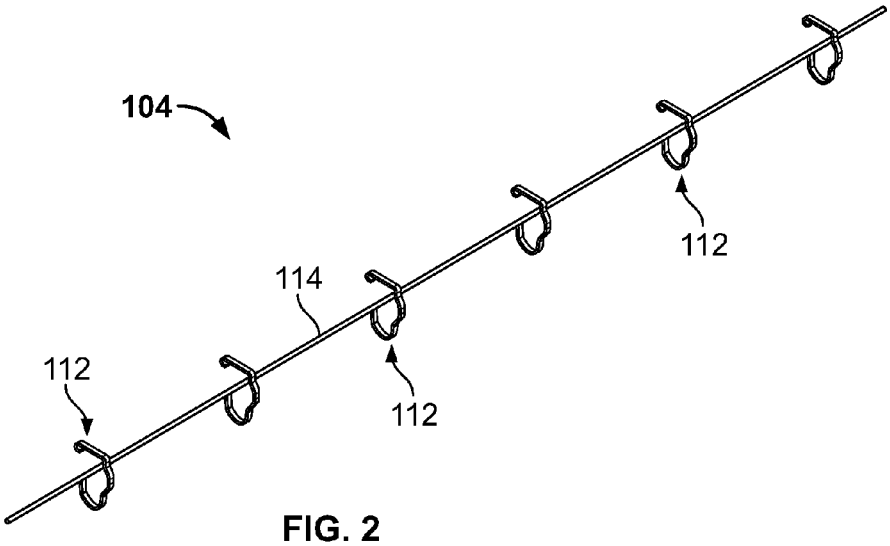
FIG. 2 is a perspective view of a hanger assembly of the shelving unit of FIG. 1.
Figure 3:
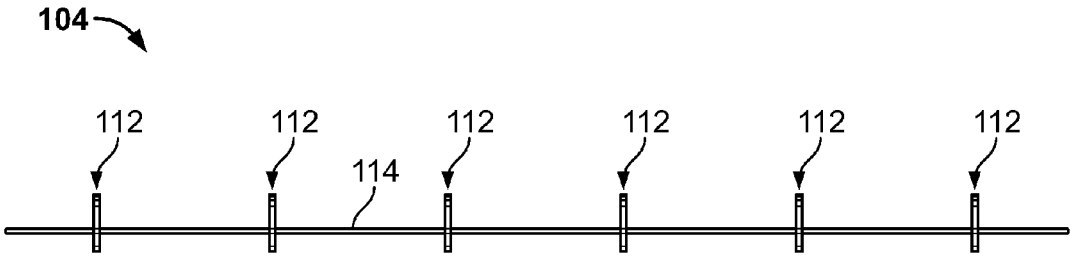
FIG. 3 is a front elevation view of the hanger assembly of FIG. 2.

With additional reference to FIGS. 2 and 3, the hanger assembly 104 includes multiple brackets 112 for use in coupling the hanger assembly 104 to the wire shelf 102. As will be described, the brackets 112 are configured to releasably couple to wire members (e.g., support members 108*a*, 108*b*, etc.) of the wire shelf 102 (e.g., via a snap fit, an interference fit, via a hanging fit, without welding, etc.). A rod 114 is coupled (e.g., releasably coupled, fixedly coupled (e.g., welded as shown in FIG. 17, etc.), etc.) to the brackets 112 for accommodating hanging items from the hanger assembly 104, for example, to allow a clothes hanger to slide along the rod 114 freely past the brackets 112 without interference therefrom. Other items (other than hangers, other than clothes, etc.) may be suspended from the rod 114 within the scope of the present disclosure. The rod 114 is disposed generally parallel to the support members 108*a-d* of the wire shelf 102 when the hanger assembly 104 is coupled thereto.

In some exemplary embodiments, the rod 114 is releasably coupled to the brackets 112, which, in turn are releasably coupled to the wire shelf 102. Accordingly, the rod 114 may be detached from the brackets 112, and the brackets 112 may be detached from the wire shelf 102. In which case, the rod 114, brackets 112, and wire shelf 102 may be packaged for shipping, storage, etc. in a single relatively small package or in multiple separate packages. The package may be shipped to a customer, who would then assemble the brackets 112 to the wire shelf 102 and the rod 114 to the brackets 112, or vice versa. In other exemplary embodiments, the brackets 112 are releasably coupled to the wire shelf 102, but the rod 114 is fixedly coupled to the brackets 112. In these other exemplary embodiments, the brackets 112 may be detached from the wire shelf 102. Then, for example, the brackets 112 with the rod 114 attached thereto may be packaged, shipped, stored, etc. separately from the wire shelf 102.

In the exemplary embodiment shown in FIGS. 1 through 7, each of the brackets 112 of the hanger assembly 104 is substantially similar or identical. As such, one of the brackets 112 will be described next with it understood that a description of the other brackets 112 is substantially the same. Alternative embodiments may, however, include one or more brackets different than the other brackets.

Figure 4:
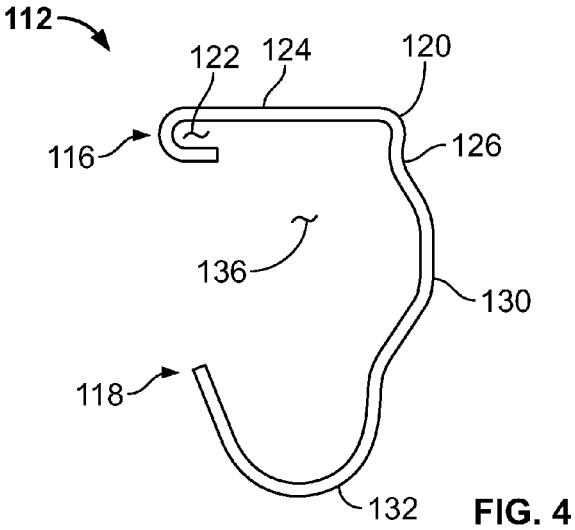

As shown in FIG. 4, the bracket 112 is generally C-shaped and is defined by a generally flat piece of material having generally uniform thickness along an entire length of the bracket 112. As an example, the bracket 112 may be formed by rolling a cylindrical, round rod or wire to a flat shape (e.g., such that the bracket 112 is also strain hardened, thereby cold working the material to provide greater stiffness and thus less deflection when subjected to loading than the base "pre-worked" material, etc.), and then forming the flat wire to the desired shape of the bracket 112. This example bracket 112 may be referred to as a snap-on flat wire bracket 112. A width of the bracket 112 may be any desired dimension within the scope of the present disclosure, for example, a width substantially matching a width between the stringers 106 of the wire shelf 102, etc. As another example, the bracket 112 may be formed from sheet metal, etc. As still another example, the bracket 112 may be formed from a wire bent to a desired shape (e.g., without rolling the wire to a flat shape, etc.). In other example embodiments, brackets may be formed from plastics or other suitable materials.

The bracket 112 generally includes first and second end portions 116, 118, and an elbow portion 120. The first end portion 116 is generally hook-shaped and defines a channel 122 that opens toward a rearward portion of the bracket 112 (generally toward the right in FIG. 4) (and generally toward the elbow portion 120). A generally straight upper member 124 extends between the first end portion 116 and the elbow portion 120. A rounded lip portion 126 is located generally below the elbow portion 120 and protrudes toward a forward portion of the bracket 112 (toward the left in FIG. 4). As such, the elbow portion 120 defines a generally rounded bend having a radial angle that is slightly greater than about ninety degrees. The bracket 112 further includes a bump-out 130 generally below the lip portion 126, and then a U-shaped portion 132 leading to the second end portion 118. With reference again to FIGS. 1-3, the rod 114 couples to the second end portion 118 of the bracket 112 which (along with the general shape of the bracket 112) thereby facilitates the movement of the clothes hanger along the rod 114 freely past the bracket 112 without interference therefrom.

In making the hanger assembly 104, a long length of the rod 114 may initially have multiple brackets 112 coupled thereto. The rod 114 can then be cut (e.g., at locations between the brackets 112, etc.) to any desired length (e.g., a six foot length, a twelve foot length, etc.) to thereby form the hanger assembly 104 with the desired length. The rod 114 and/or the brackets 112 may also be epoxy coated within the scope of the present disclosure to provide smooth surfaces (and low sliding friction). With that said, the illustrated hanger assembly 104 includes six brackets 112 positioned at generally uniform intervals (e.g., about twelve inch intervals, intervals greater than about twelve inches, intervals less than about twelve inches, etc.) along the rod 114. And, the rod 114 extends a distance (e.g., about six inches, a distance greater than about six inches, a distance less than about six inches, etc.) beyond each of the end brackets 112. Also in this example, the rod 114 may have an overall length of about 72 inches (e.g., 72.39 inches, etc.) and a diameter of about ¼ inch (e.g., 0.28 inches or 7 millimeters, etc.). In other example embodiments, hanger assemblies can include more than or fewer than six brackets and/or have other sizes than disclosed herein. For example, a hanger assembly (e.g., hanger assembly 304 in FIG. 12, etc.) may include a rod having an overall length of about 144 inches (e.g., 144.39 inches, etc.) and twelve brackets positioned at generally uniform intervals (e.g., about twelve inch intervals, intervals greater than about twelve inches, intervals less than about twelve inches, etc.) along the rod. Also in the illustrated embodiment, the rod 114 is shown as a generally hollow tube (e.g., metal tube, plastic tube, etc.). And, the second end portion 118 of each of the brackets 112 extends generally into the hollow portion of the rod 114 when the brackets 112 and the rod 114 are coupled together (see, e.g., FIGS. 6 and 7, etc.). But the rod 114 could alternatively be a solid metal rod 114 (e.g., a one gauge size solid metal rod, etc.), a plastic rod 114, etc. within the scope of the present disclosure.

With reference now to FIGS. 5-7, installation of the hanger assembly 104 to the wire shelf 102 will be described. In the illustrated embodiment, the brackets 112 are positioned generally over wire stringers 106 of the wire shelf 102 when the hanger assembly 104 is installed to the wire shelf 102. This is accomplished utilizing a slot opening or groove 134 defined in the first end portion 116, the upper member 124, the elbow portion 120, and the lip portion 126 of each of the brackets 112. Alternatively, the brackets 112 of the hanger assembly 104 could be positioned simply between adjacent wire stringers 106 of the wire shelf 102 when installing the hanger assembly 104 to the wire shelf 102 within the scope of the present disclosure.

To install the hanger assembly 104 to the wire shelf 102 (as illustrated in FIGS. 5-7), the brackets 112 of the hanger assembly 104 are first positioned below the wire shelf 102 with the slot opening or groove 134 of each of the brackets 112 generally aligned with a wire stringer 106 of the wire shelf 102. The brackets 112 are then raised partly through the wire shelf 102, with the wire stringers 106 received in the slot openings or grooves 134. A portion of each of the brackets 112 (e.g., including the first end portion 116, the upper member 124, and the elbow portion 120, etc.) is then positioned generally above forward and rearward support members 108*a*, 108*b* of the wire shelf 102. Next, the first end portion 116 of each of the brackets 112 is positioned such that the forward support member 108*a* is received within the channel 122 of the first end portion 116. And, the brackets 112 are then rotated downwardly (generally pivoting about the forward support member 108*a*) until the lip portion 126 of each of the brackets 112 engages the rearward support member 108*b* (FIGS. 5 and 6).

At this point, it should be appreciated that the forward and rearward support members 108*a*, 108*b* of the wire shelf 102 are spaced apart a distance generally corresponding to a distance between the first end portion 116 and the elbow portion 120 of each of the brackets 112. But a distance between the first end portion 116 and the lip portion 126 of each of the brackets 112 is less than a distance between the first end portion 116 and the elbow portion 120. As such, the lip portion 126 of each of the brackets 112 initially resists movement of the rearward support member 108*b* into the elbow portion 120 of each of the brackets 112. But the brackets 112 are resiliently flexible such that a further force can be applied to the brackets 112 pulling (or pushing) them downwardly, causing them to flex and thereby allow movement of the rearward support member 108*b* past the lip portion 126 and into the elbow portion 120 of each of the brackets 112 (FIG. 7). This resilient nature of the brackets 112 then also repositions the lip portion 126 of each of the brackets 112 generally under the rearward support member 108*b* to help maintain the coupling of the brackets 112 to the support members 108*a*, 108*b* (and help retain the rearward support member 108*b* within the bend of the elbow portion 120 of each of the brackets 112). As such, in the illustrated embodiment a snap-fit (or interference) engagement fit is provided between the brackets 112 and the support members 108*a*, 108*b* of the wire shelf 102. What's more, the brackets 112 can be removed from the support members 108*a*, 108*b* in a similar fashion as desired. Other types of engagement fits (e.g., other than snap-fit engagement fits, etc.) may be used in other example embodiments (e.g., hanging engagement fits, gravity engagement fits, etc.).

As can be seen (FIG. 4), the brackets 112 of the hanger assembly 104 each have a border (e.g., extending from the first end portion 116 to the second end portion 118, etc.) that generally defines a common interior region 136 for receiving both the forward and the rearward support members 108*a*, 108*b* of the wire shelf 102 therein when the hanger assembly 104 is coupled to the wire shelf 102.

FIGS. 8-11 illustrate another example embodiment of a shelving unit 200 including one or more aspects of the present disclosure. The shelving unit 200 is substantially similar to the shelving unit 100 previously described and illustrated in FIGS. 1-7. For example, the shelving unit 200 generally includes a wire shelf 202 and a hanger assembly 204 (having brackets 212 and a rod 214) configured to couple thereto. In this embodiment, however, the wire shelf 202 includes a different arrangement of support members 208*a-d*. As such, when the hanger assembly 204 is coupled to the support members 208*a*, 208*c*, it is located generally further forward of the wire shelf 202 than in the shelving unit 100 illustrated in FIGS. 1-7 (however, both could still have similar hangs (e.g., a twelve-inch hang, etc.).

FIGS. 12 and 13 illustrate an example embodiment of a hanger assembly 304 suitable for use with shelving units (e.g., shelving units 100, 200, etc.) of the present disclosure (and for coupling to wire shelves (e.g., wire shelves 102, 202, etc.) of the present disclosure). The hanger assembly 304 includes multiple brackets 312, and a rod 314 coupled to each of the brackets 312. In particular, the illustrated hanger assembly 304 includes twelve brackets 312. But other example embodiments may have hanger assemblies including more than or fewer than twelve brackets. Other aspects of the hanger assembly 304 of this embodiment are substantially similar to those of the hanger assembly 104 previously described with reference to FIGS. 1-7.

FIGS. 14 and 15 illustrate an example embodiment of a bracket 412 suitable for use, for example, with a hanger assembly (e.g., hanger assembly 104, 204, 304, etc.) of the present disclosure (and thereby suitable for use with shelving units (e.g., shelving units 100, 200, etc.) of the present disclosure for coupling to wire shelves (e.g., wire shelves 102, 202, etc.)). In this embodiment, example dimensions are provided for the bracket 412. However, it should be appreciated that the dimensions are only exemplary in nature and do not limit the scope of the present disclosure. In addition in this embodiment, the bracket 412 does not include a slot opening or groove (e.g., a slot opening or groove is not defined in a first end portion 416, an upper member 424, an elbow portion 420, a lip portion 426, etc. of the bracket 412). As such, the bracket 412 is configured to be positioned between adjacent wire stringers of a wire shelf when installing a hanger assembly including the bracket 412 to a wire shelf. With that said, other aspects of the bracket 412 of this embodiment are substantially similar to those of the bracket 112 previously described with reference to FIGS. 1-7.

FIGS. 16 and 17 illustrate an example embodiment of a storage system 540 incorporating a shelving unit 500 having one or more aspects of the present disclosure. The illustrated storage system 540 generally includes the shelving unit 500, having a wire shelf 502 and a hanger assembly 504. Multiple standards 542 and mounts 544 (coupled to the wire shelf 502 and configured to couple to the standards 542) are also provided for use in supporting, suspending, etc. the shelving unit 500 (FIG. 16) (e.g., from a wall, etc.). Additional supports (e.g., posts, wall mounts, etc.) may be used to further support the shelving unit 500 (e.g., to support the wire shelf 502, a rod 514, etc. of the shelving unit) as desired.

The hanger assembly 504 of the storage system 540 includes brackets 512 and the rod 514. And, the rod 514 is shown welded to the bracket 512 (see, FIG. 17). The illustrated hanger assembly 504 is shown with three brackets 512, but could include any desired number of brackets 512 within the scope of the present disclosure. Also in this embodiment, the brackets 512 of the hanger assembly 504 do not include slot openings or grooves (e.g., a slot opening or groove is not defined in a first end portion 516, an upper member 524, an elbow portion 520, a lip portion 526, etc. of any of the brackets 512). As such, the illustrated brackets 512 are configured to be positioned between adjacent wire stringers 506 of the wire shelf 502 (FIG. 16) when the hanger assembly 504 is installed to the wire shelf 502. Other aspects of the hanger assembly 504 of this embodiment are substantially similar to those of the hanger assembly 104 previously described with reference to FIGS. 1-7.

FIGS. 18A and 18B illustrate an example embodiment of a stop 650 for use with a shelving unit 600 of the present disclosure. The stop 650 is configured for installation to a rod 614 of the shelving unit 600, for example, to thereby inhibit movement of hangers along the rod 614 and past the stop 650. For example, the stop 650 can be positioned toward an end portion of the rod 614 to thereby inhibit hangers from sliding off the rod 614 (e.g., to terminate the rod 614 a desired location under the shelving unit 600, etc.), to separate the rod 614 from an adjacent rod (of an adjacent hanger assembly), to help couple end portions of adjacent rods together (e.g., to help make efficient use of rod materials and avoid scrap rod materials, etc.), to terminate the rod 614 at a location prior to termination of a wire shelf 602 (e.g., such that the wire shelf 602 can extend past the end of the rod 614, etc.), etc. The stop 650 can be formed from any suitable material (e.g., plastic, metal, combinations thereof, etc.) within the scope of the present disclosure.

The illustrated stop 650 includes a body 652 having an opening 654 extending through a first end portion 656 (e.g., a lower end portion as viewed in FIG. 18, etc.), and a channel 658 defined in a second end portion 660 (e.g., an upper end portion as viewed in FIG. 18, etc.). The opening includes ridges, teeth, etc. to help position the rod 614 in the opening 654, and a stop to help limit the length the rod 614 can be positioned into the opening 654 (e.g., such that the rod 614 can only be positioned up to about a longitudinal center of the stop 650, etc.). In an example use, the opening 654 of the first end portion 656 is positioned over (e.g., slid over, etc.) an end portion of the rod 614 of the shelving unit 600. And, the channel 658 of the second end portion 660 is positioned over (e.g., rested on, press-fit onto, snap-fit onto, etc.) a support member 608*a* of the wire shelf 602, for example, generally between stringers, etc. of the wire shelf 602 and at a location generally above the rod 614. If a second rod (e.g., from a second shelving unit, etc.) is desired to be coupled to the stop 650 (e.g., to thereby couple the rods of the two shelving units together, etc.), the second rod can then be positioned in the opening 654 of the first end portion 656 of the stop 650 on an opposite side of the stop 650 from where the rod 614 is located. In addition, it should be appreciated that the stop 650 can be oriented in the shelving unit 600 as illustrated in FIG. 18B (with the convex portion of the body 652 of the stop 650 facing toward the right (e.g., toward the back of the shelving unit 600, etc.) as viewed in FIG. 18B), or the stop 650 could be reversed, rotated, etc. (e.g., one-hundred eighty degrees about a longitudinal axis of the stop 650, etc.) such that the rod 614 would be positioned in the opening 654 of the first end portion 656 of the stop 650 on the opposite side of the stop 650 (and such that the convex portion of the body 652 of the stop 650 would be facing toward the left (e.g., toward the front of the shelving unit 600, etc.) as viewed in FIG. 18B). Further, it should also be appreciated that the stop 650 could be installed to the shelving unit 600 with the opening 654 of the first end portion 656 positioned over the rod 614 of the shelving unit 600, and the channel 658 of the second end portion 660 positioned over one of the forward support members 608*c* or 608*d* of the wire shelf 602.

It should also be appreciated that the stop 650 could be used with one or more other shelving units of the present disclosure, or with other desired shelving units. For example, the stop 650 could be installed in the shelving unit 200 illustrated in FIGS. 8-11. Here, in an example installation, the opening 654 of the first end portion 656 of the stop 650 would be positioned over (e.g., slid over, etc.) an end portion of a rod 214 of the shelving unit 200. And, the channel 658 of the second end portion 660 would be positioned over (e.g., rested on, press-fit onto, snap-fit onto, etc.) the support member 208*d* of the wire shelf 202 of the shelving unit 200, for example, generally between stringers, etc. of the wire shelf 202 and at a location generally above the rod 214.

In other example embodiments, stops may be formed with channels defined in first and second end portions. The channels allow first end portions of the stops to be positioned over rods of shelving units, and second end portions of the stops to be positioned over support members of wire shelves of the shelving units, for example, generally between stringers, etc. of the wire shelves. Having channels defined in both the first and second end portions allows the stops to be easily positioned along the rods at locations between brackets of the shelving units such that the stops can be positioned at any location along the rods.

In other example embodiments, stops may be formed with slot openings or grooves in second end portions (generally transverse to channels defined in the second end portions) to accommodate, as necessary, stringers of wire shelves when the stops are installed thereto. This would allow the stops to be positioned along rods generally in line with the stringers of the shelves, with the slot openings or grooves then receiving the stringers therein when the stops are installed to support members of the wire shelves.

In one example embodiment, a stop of the present disclosure has the following dimensions. A height of the stop is about 69.5 millimeters. A width of a first end portion of the stop is about 25.4 millimeters, and a width of a second end portion of the stop is about 10.2 millimeters. These dimensions are exemplary in nature and do not limit the scope of the present disclosure.

FIGS. 19-22 illustrate another example embodiment of a shelving unit 700 including one or more aspects of the present disclosure. As shown in FIG. 19, the shelving unit 700 generally includes a wire shelf 702 and a hanger assembly 704 configured to couple thereto.

The wire shelf 702 of the illustrated shelving unit 700 generally includes multiple wire members arranged to form a platform (e.g., for stacking, storing, etc. items). The wire members include multiple wire stringers 706, and multiple support members 708*a*, 708*b* arranged generally transverse to the wire stringers 706 for providing support to the wire stringers 706. The wire stringers 706 are spaced to provide a ventilated structure for the wire shelf 702 while preventing relatively large items stored on the wire shelf 702 from passing between spaces between the wire members.

With additional reference to FIG. 20, the hanger assembly 704 of the illustrated shelving unit 700 includes a bracket 712 for use in coupling (e.g., releasably coupling, etc.) the hanger assembly 704 to the wire shelf 702. A rod 714 is coupled (e.g., releasably coupled, fixedly coupled (e.g., welded as shown in FIG. 16, etc.), etc.) to the bracket 712 for accommodating hanging items from the hanger assembly 704, for example, to allow a clothes hanger to slide along the rod 714 freely past the bracket 712 without interference therefrom. It should be appreciated that any desired number of brackets may be used with the hanger assembly 704, and/or that any desired length of rod may be used within the scope of the present disclosure.

The bracket 712 is defined by a generally flat piece of material having generally uniform thickness along an entire length of the bracket 712. As shown in FIG. 20, the bracket 712 generally includes first and second end portions 716, 718, and an elbow portion 720. The first end portion 716 is generally hook-shaped and defines a channel 722 that opens toward a lower portion of the bracket 712 (generally downwardly in FIG. 20) (and generally toward the elbow portion 720). A generally straight side member 724 extends between the first end portion 716 and the elbow portion 720. A rounded lip 726 portion is located generally adjacent the elbow portion 720 and protrudes generally toward the first end portion 716 of the bracket 712 (generally upwardly in FIG. 20). As such, the elbow portion 720 defines a generally rounded bend having a radial angle that is slightly greater than about ninety degrees. The bracket 712 further includes a generally U-shaped portion 732 leading from the lip portion 726 to the second end portion 718 (where the rod 714 is then coupled to the bracket 712).

With additional reference now to FIGS. 21 and 22, installation of the hanger assembly 704 to the wire shelf 702 will be described. In the illustrated embodiment, the bracket 712 is positioned generally between wire stringers 706 of the wire shelf 702 when the hanger assembly 704 is installed to the wire shelf 702 (FIG. 20). To install the hanger assembly 704 to the wire shelf 702, the hanger assembly 704 is first positioned generally forward of the wire shelf 702, with the first end portion of the bracket 712 positioned generally above upper and lower support members 708*a*, 708*b* of the wire shelf 702. Next, the first end portion 716 of the bracket 712 is positioned such that the upper support member 708*a* is received within the channel 722 of the first end portion 716. The bracket 712 is then rotated downwardly (generally counterclockwise as viewed in FIG. 22, and pivoted about the upper support member 708*a*) until the lip portion 726 of the bracket 712 engages the lower support member 708*b* (FIGS. 21 and 22).

It should be appreciated that the upper and lower support members 708*a*, 708*b* of the wire shelf 702 are spaced apart a distance generally corresponding to a distance between the first end portion 716 and the elbow portion 720 of the bracket 712. But a distance between the first end portion 716 and the lip portion 726 is less than a distance between the first end portion 716 and the elbow portion 720. As such, the lip portion 726 of the bracket 712 initially resists movement of the lower support member 708*b* into the elbow portion 720 of the bracket 712. But the bracket 712 is resiliently flexible such that a further force (as indicated by arrow 770 in FIG. 22) can be applied to the bracket 712 pulling (or pushing) it generally rearwardly of the wire shelf 702, causing it to flex and thereby allow movement of the lower support member 708*b* past the lip portion 726 and into the elbow portion 720 of the bracket 712 (FIGS. 19 and 20). This resilient nature of the bracket 712 then also repositions the lip portion 726 partially behind the lower support member 708*b* to help maintain the coupling of the bracket 712 to the support members 708*a*, 708*b* (and help retain the lower support member 708*b* within the bend of the elbow portion 720 of the bracket 712). As such, a snap-fit (or interference) engagement is provided between the bracket 712 and the support members 708*a*, 708*b* of the wire shelf 702.

FIGS. 23-25 illustrate an example embodiment of a corner connector 870 for use with shelving units 800, 800' of the present disclosure. The shelving units 800, 800' are each substantially similar to the shelving unit 200 previously described and illustrated in FIGS. 8-11. For example, the shelving units 800, 800' generally include wire shelves 802, 802' and hanger assemblies 804, 804' configured to couple thereto via brackets 812, 812'. And, the corner connector 870 is configured for installation to rods 814, 814' of the hanger assemblies 804, 804', for example, to thereby allow continuous movement of hangers along the rods 814, 814' between the shelving units 800, 800'. In particular, the corner connector 870 can be installed to adjacent end portions of the rods 814, 814' to thereby allow for the continuous movement of the hangers between the rods 814, 814'. With that said, it should be appreciated that the corner connector 870 could alternatively be used with any of the other shelving units (e.g., shelving units 100, 500, 600, 700, etc.) of the present disclosure or, further, with any other desired shelving units, for example, having adjacently positioned rods, etc. The corner connector 870 can also be used in shelving units in conjunction with the stop 650 illustrated in FIGS. 18A and 18B as desired.

As shown in FIGS. 23 and 24, the illustrated corner connector 870 includes a curved body 872 having an opening 874 at a first end portion 876, and an opening 878 at a second end portion 880. In some aspects, the corner connector 870 may be defined by a generally hollow tube structure, with a channel extending through the body 872 of the corner connector 870 and thereby defining the openings 874, 878 at the first and second end portions 876, 880. In other aspects, the corner connector 870 may be defined by a generally solid structure, with the openings 874, 878 then formed at the first and second end portions 876, 880. With that said, the corner connector 870 can be formed from any suitable material (e.g., plastic, metal, combinations thereof, etc.) within the scope of the present disclosure. In addition, the corner connector 870 may also be epoxy coated within the scope of the present disclosure to provide smooth surfaces (and low sliding friction).

In an example use (FIG. 25), the corner connector 870 is installed to end portions of the rods 814, 814' of the adjacent shelving units 800, 800' (e.g., with the shelving units 800, 800' positioned at different orientations within a closet as shown in FIG. 25, etc.). The opening 874 of the first end portion 876 is positioned over (e.g., slid over, etc.) an end portion of the rod 814 of the shelving unit 800. And, the opening 878 of the second end portion 880 is positioned over (e.g., slid over, etc.) an end portion of the rod 814' of the shelving unit 800'. As such, the corner connector 870 can provide a transition (e.g., a radius transition, etc.) between the hanger assemblies 804, 804' of the shelving units 800, 800' and, thus, an uninterrupted slide path therebetween. For example, hangers can move continuously between the rods 814, 814' of the shelving units 800, 800' across the corner connector 870. In the illustrated embodiment, the curved body 872 of the corner connector 870 defines a radial angle of about ninety-degrees. This allows the corner connector 870 to accommodate the shelving units 800, 800' offset by about ninety-degrees. In other example embodiments, corner connectors may define radial angles other than about ninety-degrees (e.g., radial angles greater than about ninety-degrees; radial angles less than about ninety-degrees, etc.) to thereby accommodate shelving units oriented differently than illustrated herein (e.g., at relative angles other than about ninety-degrees, etc.).

In one example embodiment, a corner connector of the present disclosure has the following dimensions. The corner connector has a body defined by a generally hollow tube structure, where an outer diameter of the body is about 9.6 millimeters and an inner diameter of a channel extending through the body is about 8.0 millimeters. End portions of the body are generally strait, and each extend a length of about 19.7 millimeters. A central portion of the body, extending between the end portions, is curved and defines a radial angle of about ninety-degrees with a radius of about 144.0 millimeters. These dimensions are exemplary in nature and do not limit the scope of the present disclosure.

In some aspects of the present disclosure, shelving units having twelve inch deep wire shelves and shelving units having sixteen inch deep wire shelves can be used together, for example, because rods of the shelving units would align. This is accomplished by positioning the hanger assemblies toward the front portions of the shelving units having the twelve inch deep wire shelves (e.g., as illustrated in shelving unit 200 illustrated in FIGS. 8-11, etc.) so that they have a twelve-inch hang, and positioning the hanger assemblies rearward of the front portions of the shelving units having the sixteen inch deep wire shelves (e.g., as illustrated in the shelving unit 100 illustrated in FIGS. 1-7, etc.) so that they also have a twelve-inch hang.

Specific dimensions included herein are exemplary in nature and do not limit the scope of the present disclosure. In addition, specific dimensions included herein are provided within acceptable tolerances generally common in the art (e.g., dimensions with no decimal point may include tolerances of +/−1.0 mm (0.04 inches); dimensions with one decimal point may include tolerances of +/−0.3 mm (0.01 inches); dimensions with two decimal points may include tolerances of +/−0.13 (0.005 inches); angular dimension may include tolerances of +/−2 degrees; etc.).

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. In addition, advantages and improvements that may be achieved with one or more exemplary embodiments of the present disclosure are provided for purpose of illustration only and do not limit the scope of the present disclosure, as exemplary embodiments disclosed herein may provide all or none of the above mentioned advantages and improvements and still fall within the scope of the present disclosure.

Specific dimensions, specific materials, and/or specific shapes disclosed herein are example in nature and do not limit the scope of the present disclosure. The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter (i.e., the disclosure of a first value and a second value for a given parameter can be interpreted as disclosing that any value between the first and second values could also be employed for the given parameter). For example, if Parameter X is exemplified herein to have value A and also exemplified to have value Z, it is envisioned that parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, and 3-9.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The term "about" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters. For example, the terms "generally," "about," and "substantially," may be used herein to mean within manufacturing tolerances. Whether or not modified by the term "about," the claims include equivalents to the quantities.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements, intended or stated uses, or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A shelving unit comprising:

a wire shelf having multiple wire members arranged to form a platform;

a bracket configured to releasably couple to wire members of the wire shelf, the bracket including a hook-shaped end portion and an elbow portion, the hook-shaped end portion of the bracket defining a channel that opens toward the elbow portion for receiving a first one of the wire members, and the elbow portion of the bracket defining a bend for receiving a second one of the wire members to thereby releasably couple the bracket to the wire shelf with the first and second one of the wire members disposed within a common interior region defined between the hook-shaped end portion and the elbow portion when the bracket is releasably coupled to the wire shelf; and a rod coupled to the bracket;

wherein the bracket further includes an upper member extending between the hooked-shaped end portion and the elbow portion, the upper member defining a slot opening configured to receive at least a portion of a third one of the wire members of the wire shelf therein that is perpendicular to the first and second ones of the wire members, and wherein the upper member spans over and across a horizontal distance separating the first and second ones of the wire members when the bracket is releasably coupled to the first and second ones of the wire members of the wire shelf.

2. The shelving unit of claim 1, wherein the first and second ones of the wire members of the wire shelf extend generally parallel to the rod, wherein the first and second ones of the wire members are forward and rearward support members of the wire shelf that are horizontally spaced apart, and wherein the channel defined by the hook-shaped end portion opens rearwardly toward a rearward portion of the bracket.

3. The shelving unit of claim 1, wherein the hook-shaped end portion of the bracket is a first end portion, the bracket further having a second end portion; and wherein the rod is coupled to the second end portion of the bracket such that a clothes hanger can slide along the rod freely past the bracket without interference therefrom.

4. The shelving unit of claim 3, wherein the rod is welded or releasably coupled to the second end portion of the bracket.

5. The shelving unit of claim 1, wherein the bracket is defined by a single piece of flat wire or sheet metal having a generally uniform thickness along an entire length of the bracket.

6. The shelving unit of claim 1, wherein the bend of the elbow portion defines a radial angle greater than ninety degrees to thereby facilitate a snap-fit engagement of the bracket to the wire shelf, and wherein the bracket is made of flat wire such that the bracket is a snap-on flat wire bracket.

7. The shelving unit of claim 1, wherein the bracket is a first bracket, the shelving unit comprising at least one additional bracket.

8. A hanger assembly for use with a wire shelf, the hanger assembly comprising:

at least one bracket configured to releasably couple to a wire shelf, the at least one bracket having a border defining a common interior region for receiving multiple wire members of the wire shelf within the same common interior region defined by the border when releasably coupling the at least one bracket to the wire shelf; and wherein the at least one bracket includes:

a hook-shaped end portion for receiving a first one of the wire members of the wire shelf when releasably coupling the at least one bracket to the wire shelf;

a rounded elbow portion spaced apart from the hook-shaped end portion for receiving a second one of the wire members of the wire shelf when releasably coupling the at least one bracket to the wire shelf, the rounded elbow portion defining a radial angle greater than ninety degrees to thereby facilitate a snap-fit engagement of the rounded elbow portion to the second one of the wire members after the first one of the wire members is received in the hook-shaped end portion; and the common interior region is between the hook-shaped end portion and the rounded elbow portion;

a rod coupled to the at least one bracket;

wherein the at least one bracket includes an upper member having a slot opening formed therein for receiving at least a portion of a wire member of the wire shelf therein that is perpendicular to the multiple wire members within the common interior region and wherein the upper member spans over and across a horizontal distance separating the multiple wire members within the common interior region when the at least one bracket is releasablv coupled to the wire shelf.

9. The hanger assembly of claim 8, wherein the at least one bracket includes an end portion, and wherein the rod is fixedly or releasably coupled to the end portion of the at least one bracket such that a clothes hanger can slide along the rod freely past the at least one bracket without interference therefrom.

10. The hanger assembly of claim 8, wherein the at least one bracket is defined by a single piece of flat wire or sheet metal having a generally uniform thickness along an entire length of the bracket.

11. The hanger assembly of claim 8, wherein the at least one bracket includes multiple brackets.

12. A shelving unit comprising:

a wire shelf having multiple wire members arranged to form a platform;

a bracket configured to releasably couple to the wire shelf, the bracket including an end portion configured to receive a first one of the wire members of the wire shelf and an elbow portion configured to receive a second one of the wire members of the wire shelf such that the first and second ones of the wire members are within a common interior region defined between the end portion and the elbow portion when the bracket is releasably coupled to the wire shelf, the bracket further including a lip portion disposed adjacent the elbow portion, wherein a distance between the end portion of the bracket and the lip portion is less than a distance between the end portion of the bracket and the elbow portion such that the lip portion operates to at least partially retain the second one of the wire members in the elbow portion when the bracket is releasably coupled to the wire shelf; and a rod coupled to the bracket;

wherein the bracket further includes an upper member extending between the end portion and the elbow portion, the upper member defining a slot opening configured to receive at least a portion of a third one of the wire members of the wire shelf therein that is perpendicular to the first and second ones of the wire members, and wherein the upper member spans over and across a horizontal distance separating the first and second ones of the wire members when the bracket is releasablv coupled to the first and second ones of the wire members of the wire shelf.

13. The shelving unit of claim 12, wherein the end portion of the bracket is a first end portion, the bracket including a second end portion; and wherein the rod is fixedly or releasably coupled to the second end portion of the bracket.

14. The shelving unit of claim 12, wherein the bracket is defined by a single piece of flat wire or sheet metal having a generally uniform thickness along an entire length of the bracket.

15. The shelving unit of claim 12, wherein the bracket defines a general C shape.

16. The shelving unit of claim 12, wherein the bracket includes a generally uniform thickness along an entire length of the bracket.

17. The shelving unit of claim 12, further comprising a stop for inhibiting movement of hangers along the rod and past the stop.

18. The shelving unit of claim 12, further comprising a corner connector for coupling the rod of the shelving unit to a rod of an adjacent shelving unit.

* * * * *